US006105903A

United States Patent [19]

Chen

[11] Patent Number: 6,105,903

[45] Date of Patent: Aug. 22, 2000

[54] INFLATABLE FLYING TOY

[76] Inventor: David Chen, No. 140, Hsin-Ma Rd., Suao Town, Ilan County, Taiwan

[21] Appl. No.: 09/177,624

[22] Filed: Oct. 23, 1998

[30] Foreign Application Priority Data

Mar. 20, 1998 [TW] Taiwan ..... 97204095

[51] Int. Cl.[7] ..... B64C 31/06

[52] U.S. Cl. ..... 244/153 R; 446/61; 446/230; 446/225

[58] Field of Search ..... 244/153 R, 154, 244/155 R, 155 A; 446/61, 63, 64, 225, 230

[56] References Cited

U.S. PATENT DOCUMENTS

| | | | |
|---|---|---|---|
| 1,408,001 | 2/1922 | Hauck | 446/64 |
| 2,817,185 | 12/1957 | Johnson | 446/63 |
| 4,026,504 | 5/1977 | Christoffel, Jr. | 244/155 A |
| 4,878,636 | 11/1989 | Mileti | 244/155 A |
| 5,281,179 | 1/1994 | Wu | 446/61 |
| 5,524,851 | 6/1996 | Huang | 446/61 |

FOREIGN PATENT DOCUMENTS

| | | | |
|---|---|---|---|
| 2216431 | 10/1989 | United Kingdom | 244/153 R |
| 2280381 | 2/1995 | United Kingdom | 244/155 R |

*Primary Examiner*—Galen L. Barefoot
*Attorney, Agent, or Firm*—Dougherty & Troxell

[57] ABSTRACT

An inflatable flying toy made of plastic membrane. The flying toy is formed with several inflatable air passages communicated with each other. After inflated, the air passages are expanded to serve as a support frame for stretching and supporting the flying toy into a kite form. At predetermined positions of the air passages are disposed latch holes or wing holes connecting with a hook injection member or tied with a pull string. The hook injection member can be hooked with a catapult which is able to resiliently inject the flying toy as a glider. A pull string can be tied with the flying toy to control the flying or floating direction of the kite by pulling.

5 Claims, 10 Drawing Sheets

INFLATABLE FLYING TOY

BACKGROUND OF THE INVENTION

The present invention relates to an inflatable flying toy which can be played as a kite floating in the air or resiliently injected to fly as a glider.

A conventional kite is manually made of slender bamboo strip and light paper such as motto paper. Such kite cannot be mass-produced and the cost is relatively high. Moreover, such kite cannot be disassembled and folded so that it is inconvenient to carry the kite and it often takes place that the kite is damaged when carried.

U.S. Pat. No. 3,952,975 discloses an inflatable kite which is made of plastic membrane and formed with longitudinal and transverse inflatable air passages communicating with each other. After inflation, the air passages are expanded to form support frames of the inflatable kite. However, in use, such inflatable kite has some shortcomings as follows:

1. The above inflatable kite can be played in only one manner so that it is monotonous to play such kite.

2. A controlling pull ring is tied to the pull string for pulling and controlling the kite. After a period of use or when subject to strong wind, the pull ring tends to break.

3. The entire kite is made of double-layer plastic membrane so that the kite has a heavy weight and is hard to float in the air.

SUMMARY OF THE INVENTION

It is a primary object of the present invention to provide an inflatable flying toy which can be played as a kite floating in the air or resiliently injected by a catapult to fly as a glider. Many such flying toys can be connected into a series of flying toys to achieve more entertaining effect.

It is a further object of the present invention to provide the above flying toy in which the inflatable air passages are formed with latch holes for connecting with a hook injection member. The pull string is more reliably tied to the latch hole instead of the conventional pull ring.

It is still a further object of the present invention to provide the above flying toy in which only the air passages serving as the support frame are made of double-layer plastic membrane, while the remaining portions are made of single layer of plastic membrane so that the total weight of the flying toy is reduced to facilitate floating in the air. In addition, the flying toy is made without any hard part and designed with attractive appearance.

The present invention can be best understood through the following description and accompanying drawings, wherein:

DETAILED DESCRIPTION OF THE PREFERRED EMBODIMENTS

Figure 1:
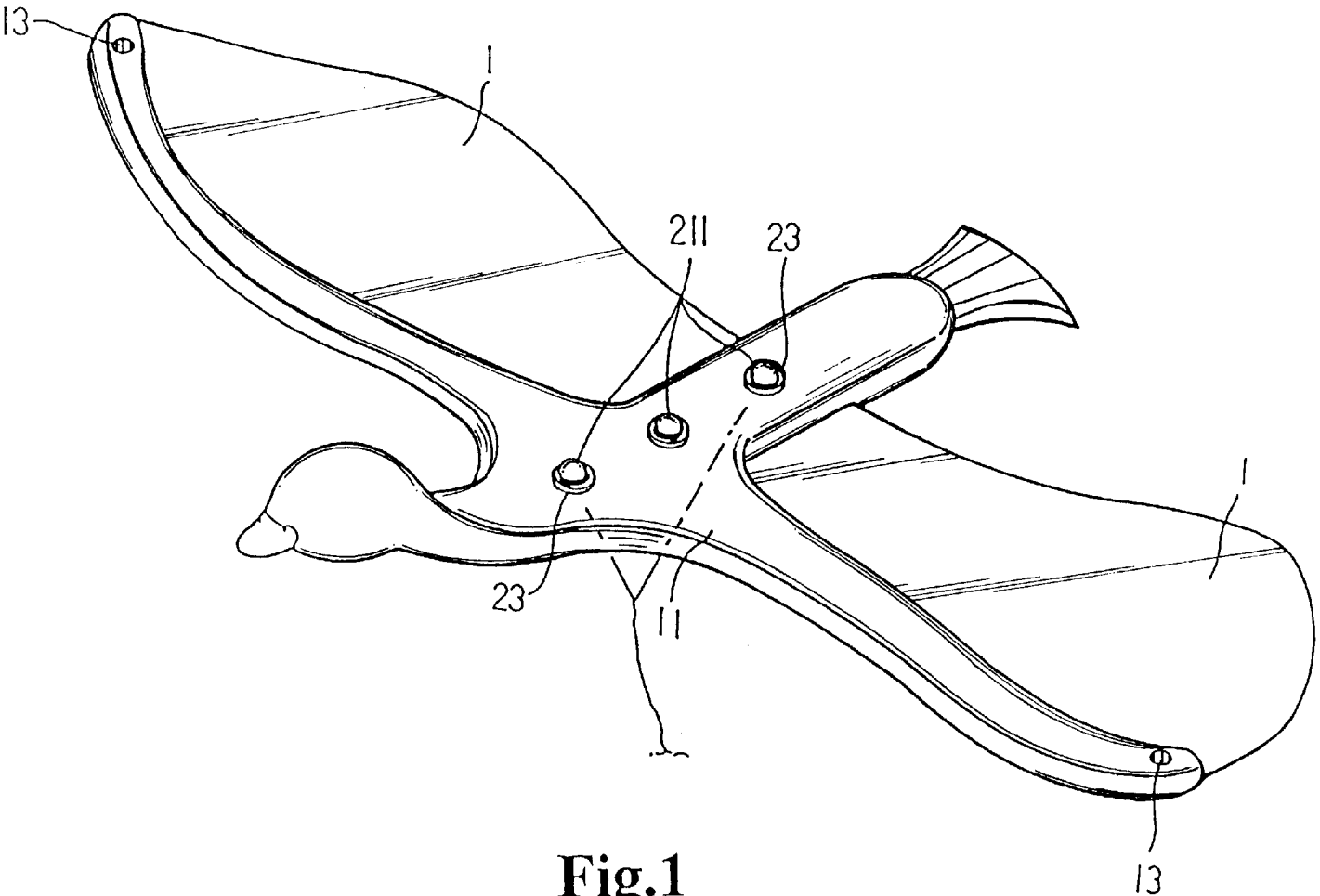
FIG. 1 is a perspective assembled view of the present invention.
Figure 2A:
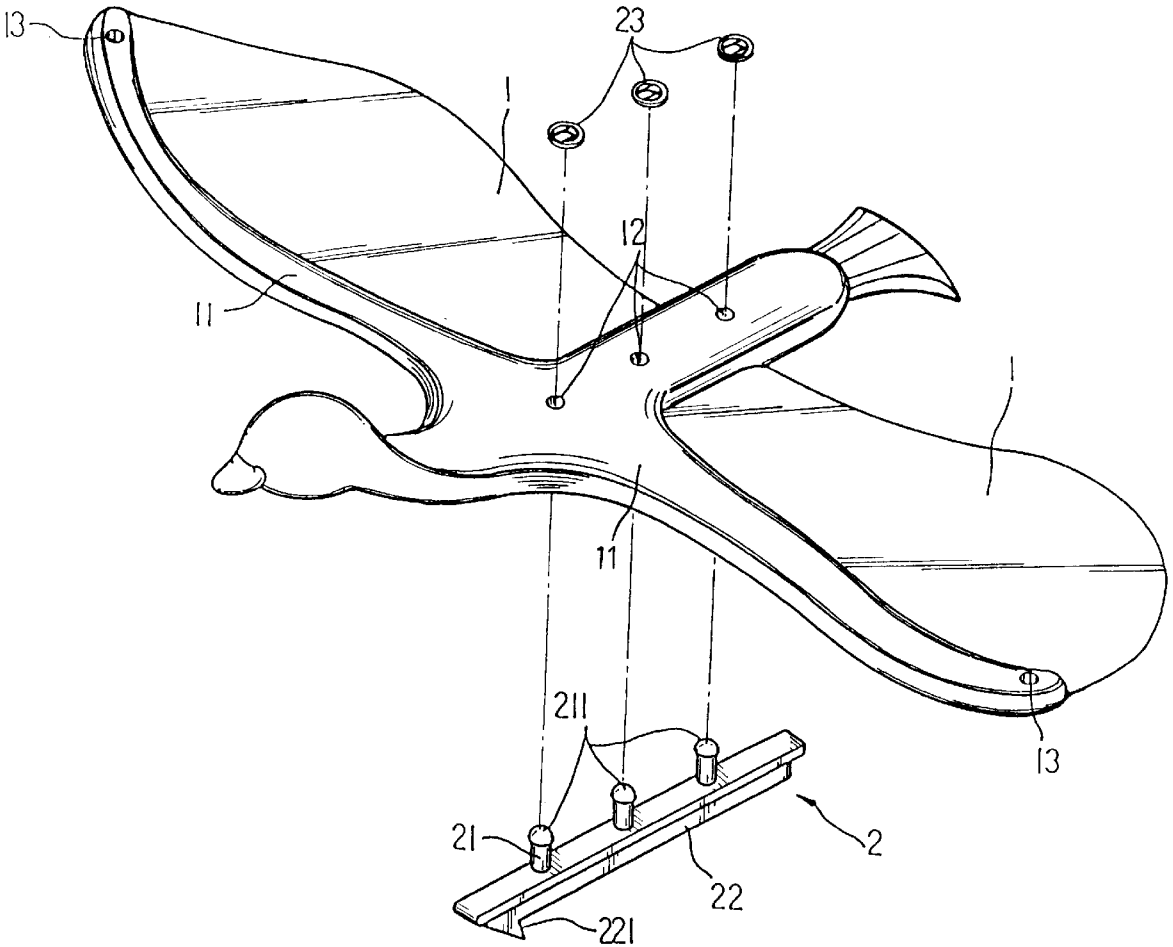
FIG. 2A is a perspective disassembled view of the present invention.
Figure 2B:
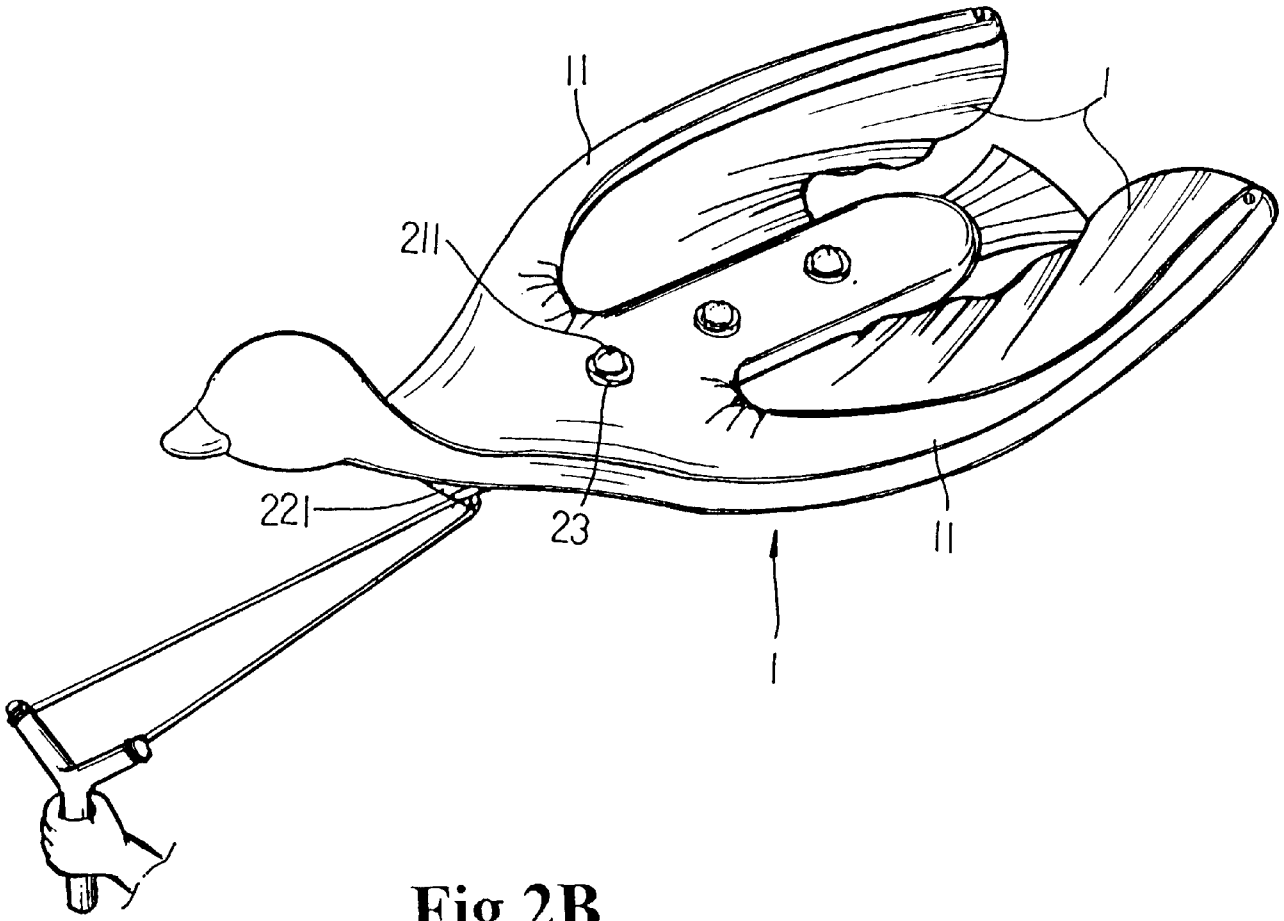
FIG. 2B shows that the flying toy of the present invention is resiliently injected.

Please refer to FIGS. 1 and 2A. The present invention is made of plastic membrane 1 in a form of animals or other objects. At necessary support frame position, longitudinal and transverse air passages 11 are formed by double-layer plastic membrane and communicated with each other. After being inflated and expanded, the air passages 11 serve as support frame for stretching the entire body. The remaining portions are made of single layer of plastic membrane and connected to the air passages 11. At necessary positions of the air passages 11 are disposed latch holes 12 or wing holes 13 communicating with the air passages 11. A hook injection member 2 can be connected with the flying toy. The hook injection member 2 is disposed with vertically extending latch posts 21 each having a latch cap 211 at a top end. In cooperation with a buckle 23, the latch post 21 is passed through the latch hole 12 of the air passage 11 to be fastened by the buckle 23. A hook section 22 is formed on a lower side of the hook injection member 2. The front end of the hook section 22 is formed with a downward extending reverse hook 221 for hooking a catapult and resiliently injecting the flying toy as a glider. The present invention is free from any hard or rigid part so that as shown in FIG. 2B, when injected, the wing sections can be collected inward to reduce the resistant force against the injection and increase the injection travel. After injected, the resilient restoring force of the flying toy itself will naturally restore and stretch the flying toy to its home flying pattern.

Figure 3:
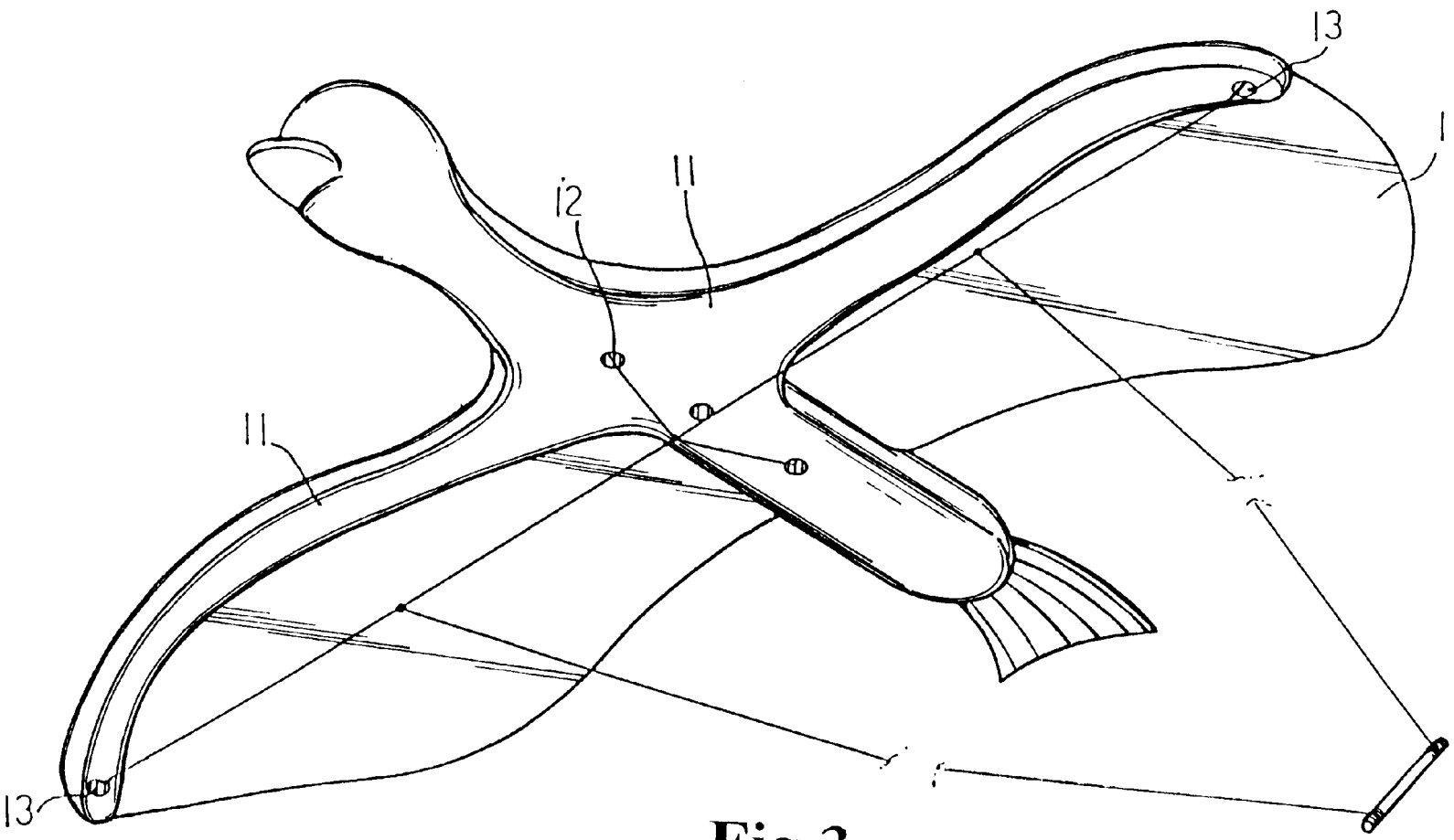
FIG. 3 shows that the flying toy is tied to a pull string.

Please refer to FIG. 3 which shows that the flying toy is tied with a pull string. A pull string 3 can be tied between the latch holes 12 and the wing holes 13 of the air passage 11 to form a kite controllable by pulling. In order to more reliably control the kite, the pull string between the wing holes 13 can be replaced by a rigid slender rod (not shown) to achieve better effect.

Figure 4:
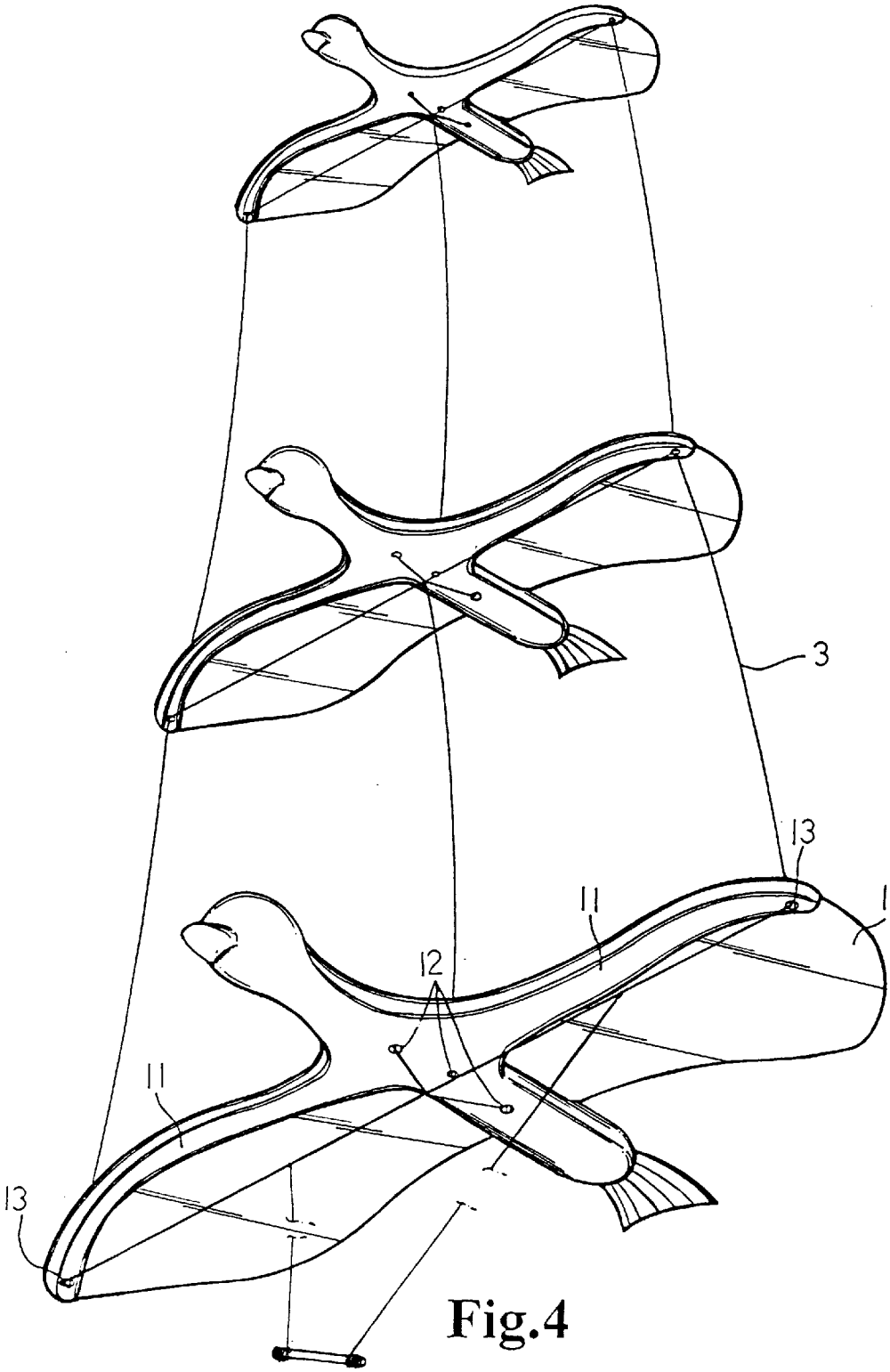
FIG. 4 shows that many flying toys are serially connected to each other.

Referring to FIG. 4, several flying toys can be serially connected by pull strings 3 to form an elongated flying toy set.

Figure 5:
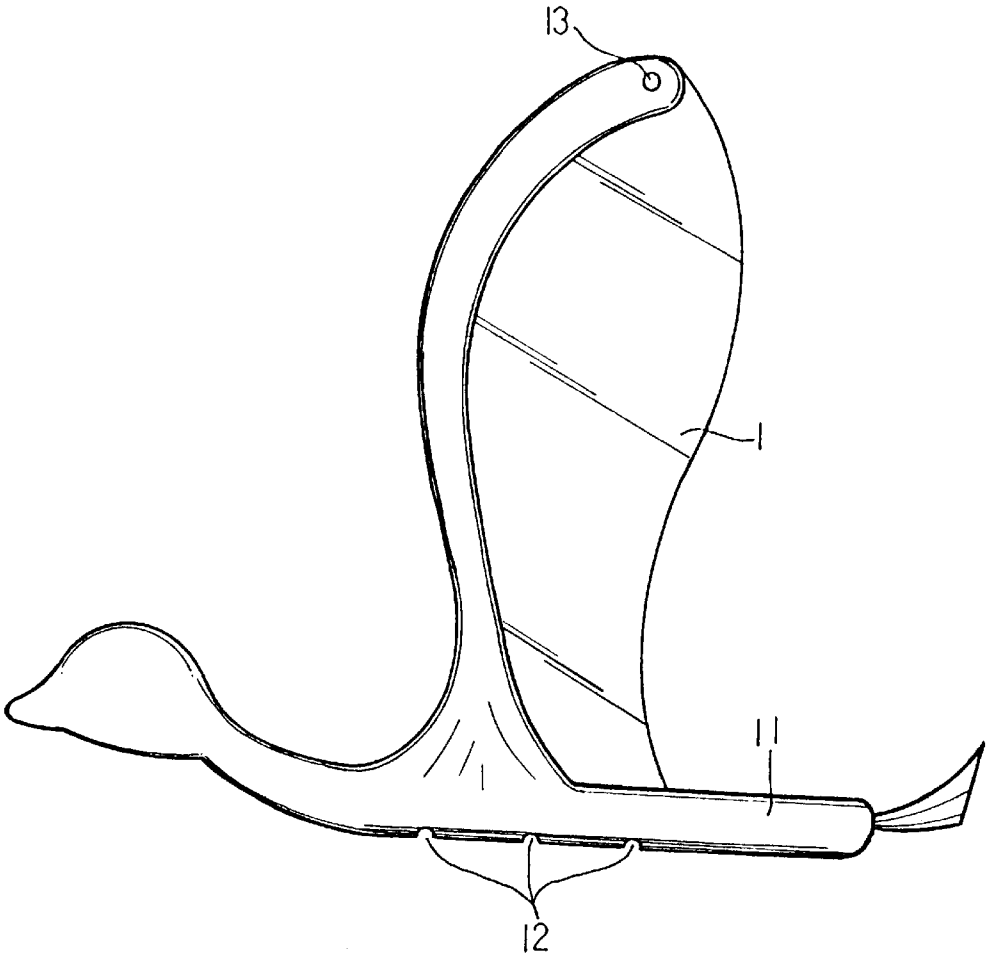
FIG. 5 shows the flying toy in a folded state.
Figure 6:
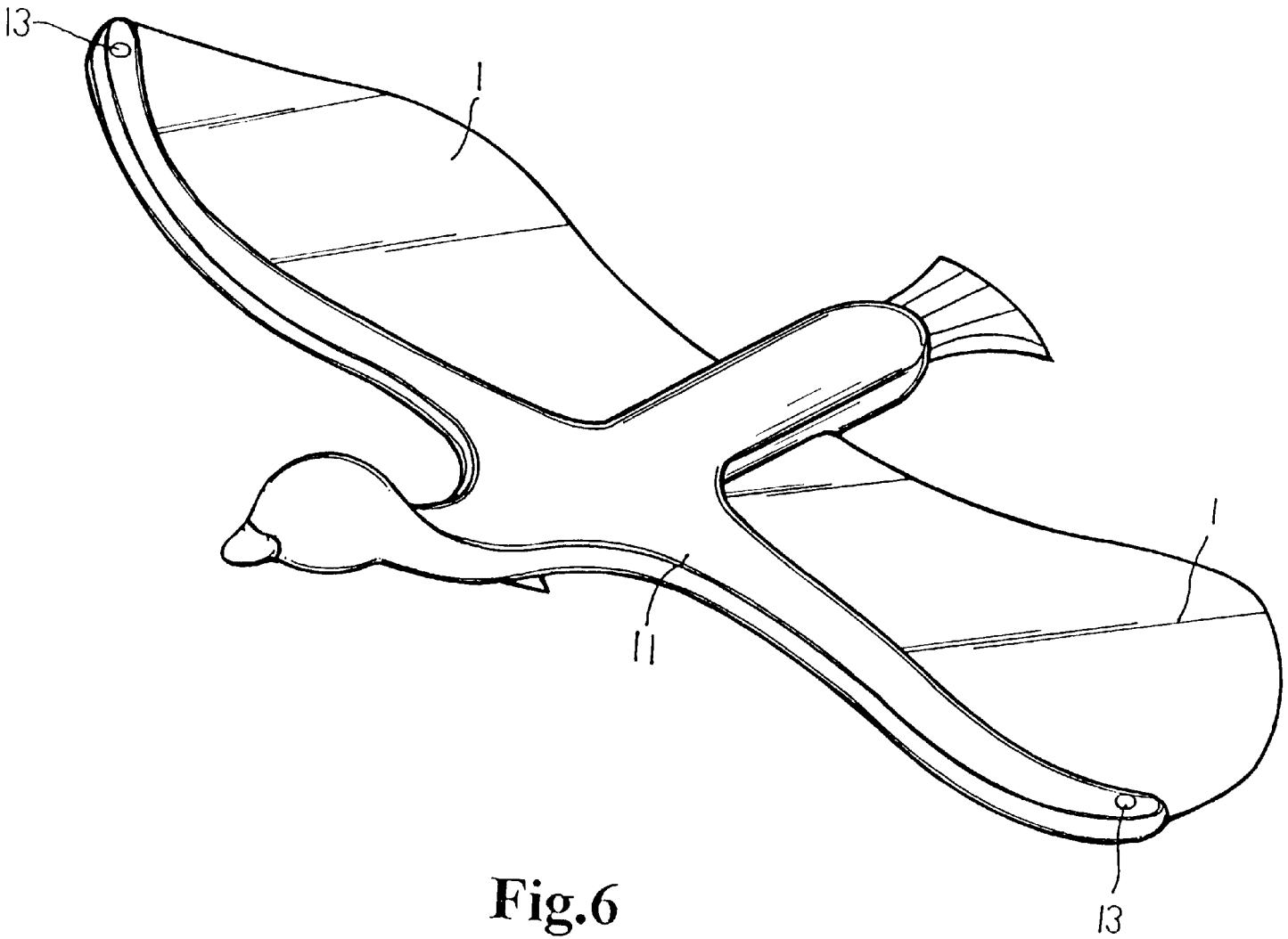
FIG. 6 is a perspective assembled view of another embodiment of the present invention.
Figure 7:
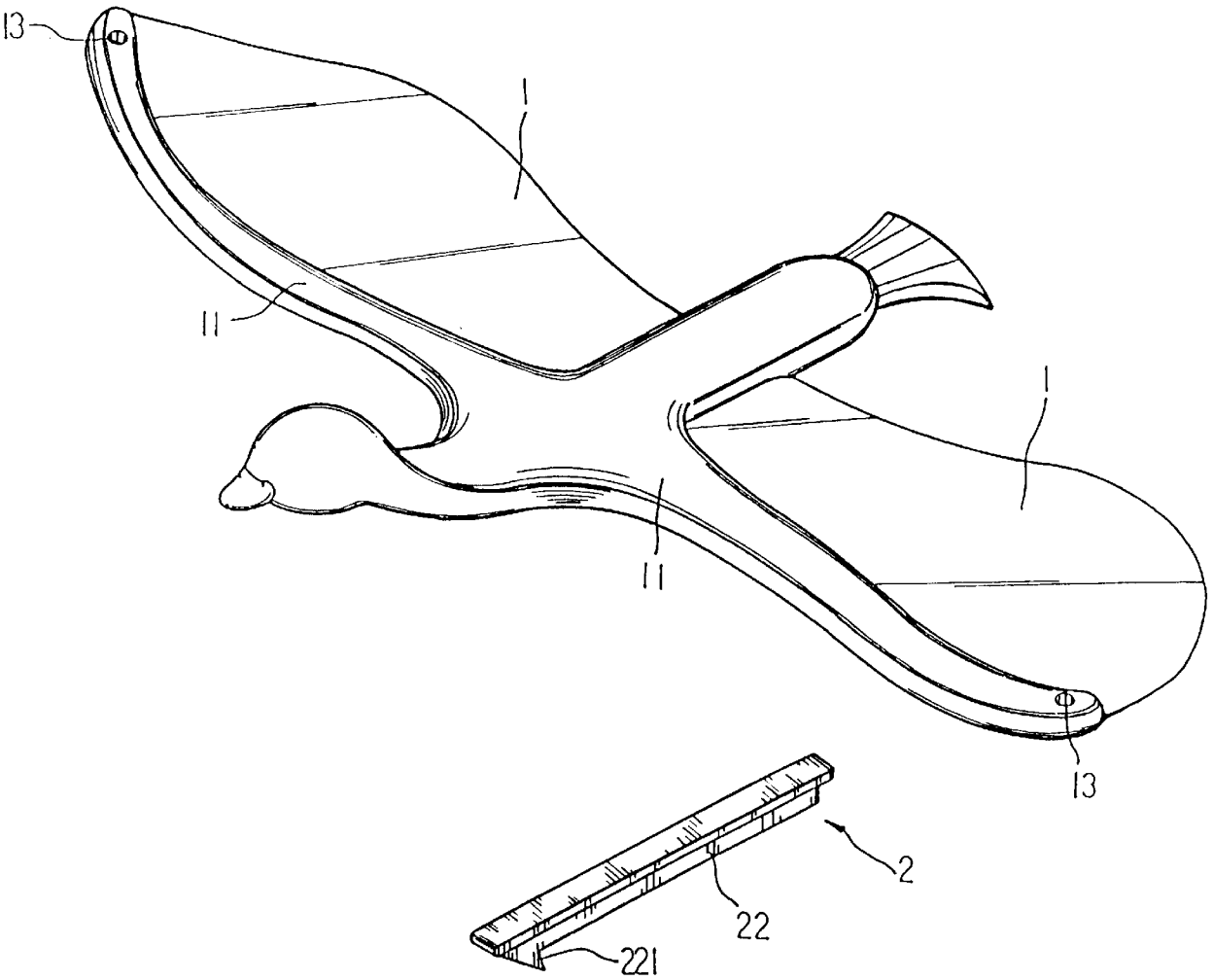
FIG. 7 is a perspective disassembled view of the embodiment of the present invention according to FIG. 6.
Figure 8:
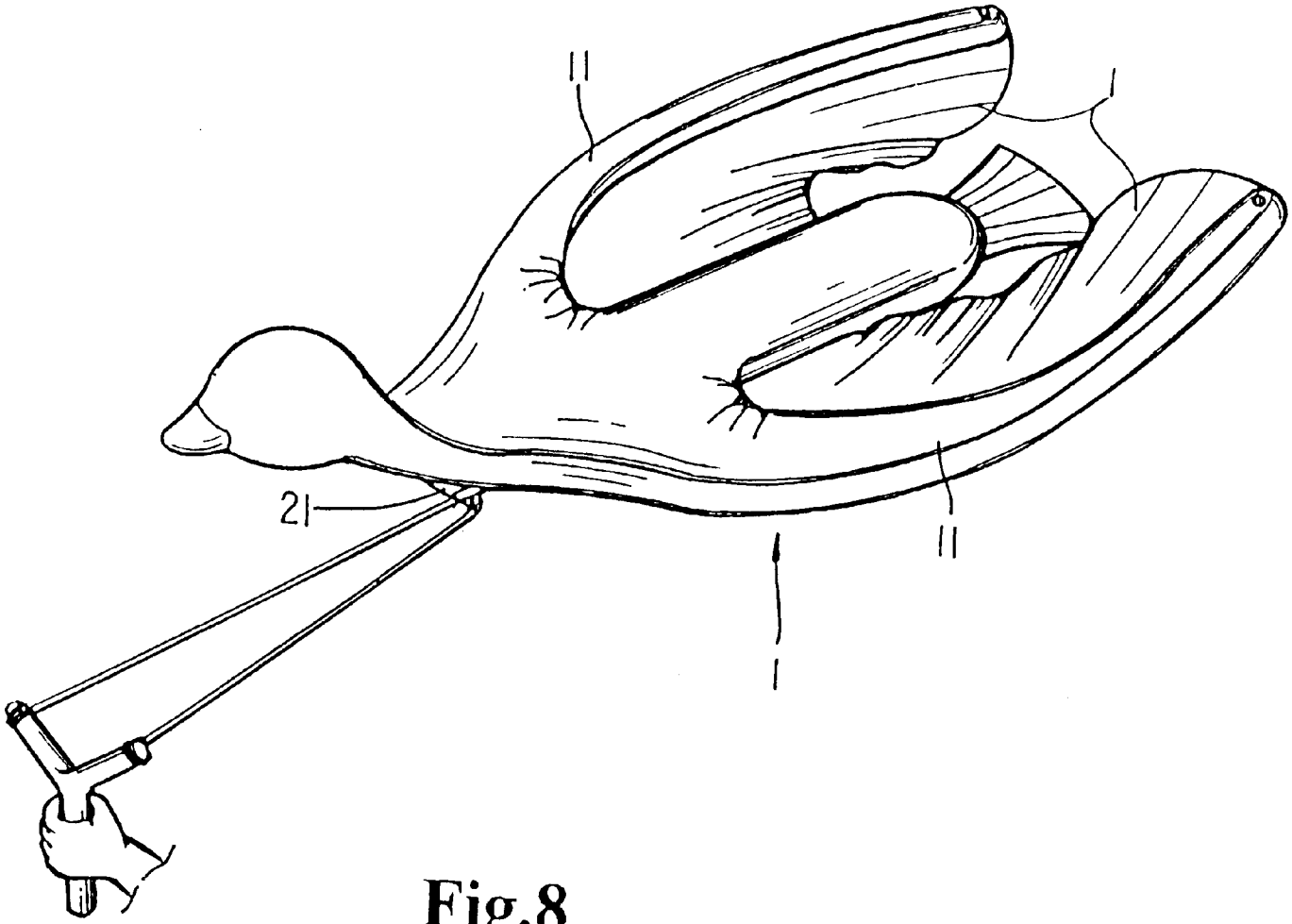
FIG. 8 shows that the flying toy according to FIG. 6 is resiliently injected.
Figure 9:
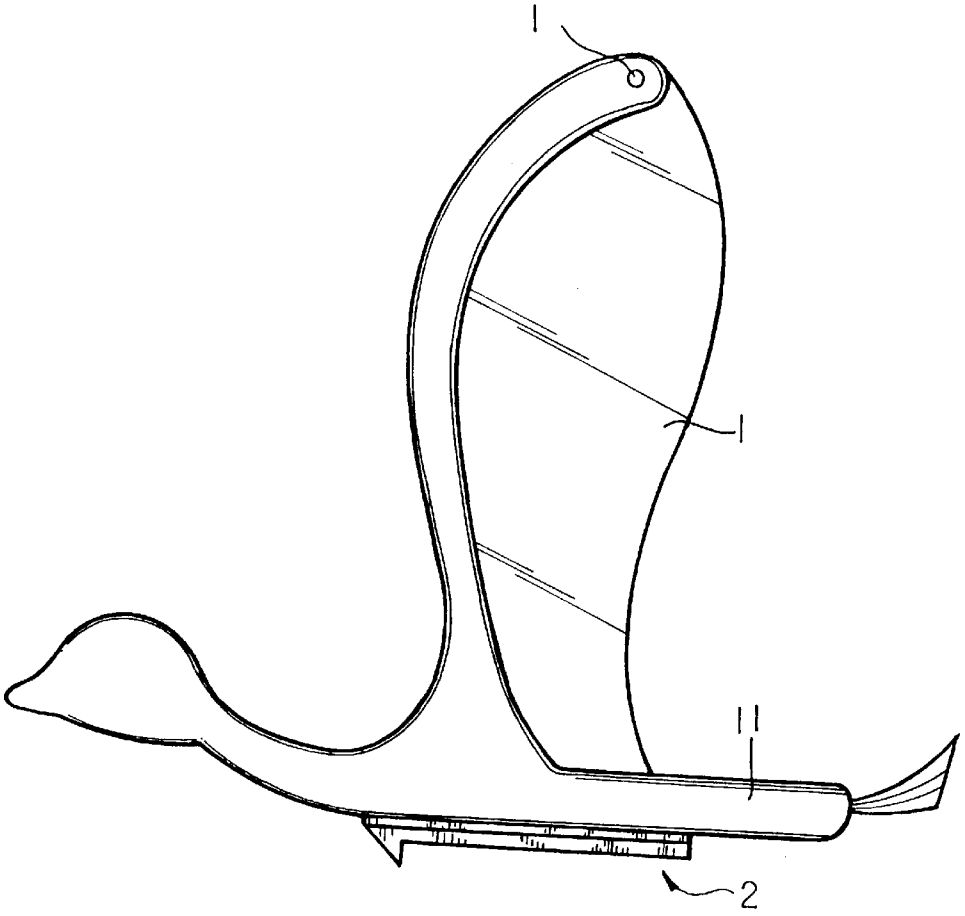
FIG. 9 shows the embodiment according to FIG. 6 in a folded state.

Referring to FIG. 5, when collected and folded, the air passages 11 are deflated and collapsed. Thereafter, the flying toy can be folded to facilitate carriage without occupying much room.

FIGS. 6, 7, 8 and 9 show another embodiment of the present invention, in which the hook injection member 2 is adhered to or fused with the air passages 11 by an adhesive or a thermal fusing machine (such as high frequency, ultrasonic and thermoprocessing machine). Therefore, the hook injection member 2 is fully associated with the flying toy with a reinforced strength. Also, the processing procedure is simplified and the appearance of the flying toy is enhanced.

In addition, multi-layer plastic sheets or attaching sheets are attached to the peripheries of the latch holes 12 or wing holes 13 so as to reinforce the same and increase the association strength between the flying toy and the hook injection member 2 or the pull string 3 and minimize the damage resulting from the folding procedure.

According to the above arrangements, the flying toy of the present invention has simple structure and can be easily assembled. In cooperation with the hook injection member 2 and the catapult, the flying toy can be resiliently injected as a glider. In addition, the pattern of the flying toy can be freely designed without limitation. The production efficiency of the flying toy can be increased at low cost. The body of the flying toy is made of single layer of plastic membrane and the air passages are made of double-layer plastic membrane so that the total weight of the flying toy is reduced to facilitate floating or flying. Moreover, after folded, the flying toy is not subject to damage and occupies only little room.

It should be noted that the above description and accompanying drawings are only used to illustrate some embodiments of the present invention, not intended to limit the scope thereof. Any modification of the embodiments should fall within the scope of the present invention.

What is claimed is:

1. An inflatable flying toy capable of being flown as a kite, or launched from a catapult, comprising:

a) an inflatable body having longitudinal and transverse portions with longitudinal and transverse air passages therein the transverse portions being resiliently displaceable rearwardly to facilitate launching the flying toy from a catapult;

b) single layer uninflated lateral portions extending between the longitudinal portion and each transverse portion;

c) a hook member affixed to an underside of the longitudinal portion of the inflatable body, the hook member having a hook engageable with a catapult to launch the flying toy; and, d) a hole through each transverse portion of the inflatable body to accommodate the passage of a pull string therethrough to enable the flying toy to be flown as a kite.

2. The flying toy of claim 1 wherein the hook member is adhesively bonded to the underside of the longitudinal portion of the inflatable body.

3. The flying toy of claim 1 wherein the hook member is thermally fused to the underside of the longitudinal portion of the inflatable body.

4. The flying toy of claim 1 wherein the longitudinal portion of the inflatable body has at least one latch hole therethrough and further comprising:

a) at least one latch post extending from the hook member and passing through the at least one latch hole, the at least one latch post having a latch cap thereon; and, b) a fastening element engaging the latch cap to affix the hook member to the longitudinal portion of the inflatable body.

5. The flying toy of claim 4 wherein a diameter of the latch cap is greater than a diameter of the at least one latch hole.

* * * * *